US010008193B1

(12) United States Patent
Harvilla

(10) Patent No.: US 10,008,193 B1
(45) Date of Patent: Jun. 26, 2018

(54) METHOD AND SYSTEM FOR SPEECH-TO-SINGING VOICE CONVERSION

(71) Applicant: Mark J. Harvilla, Pasadena, CA (US)

(72) Inventor: Mark J. Harvilla, Pasadena, CA (US)

(73) Assignee: OBEN, INC., Pasadena, CA (US)

( * ) Notice: Subject to any disclaimer, the term of this patent is extended or adjusted under 35 U.S.C. 154(b) by 0 days. days.

(21) Appl. No.: 15/681,311

(22) Filed: Aug. 18, 2017

Related U.S. Application Data

(60) Provisional application No. 62/377,462, filed on Aug. 19, 2016.

(51) Int. Cl.
*G10H 1/36* (2006.01)

(52) U.S. Cl.
CPC ..... *G10H 1/366* (2013.01); *G10H 2210/066* (2013.01); *G10H 2210/081* (2013.01); *G10H 2210/165* (2013.01); *G10H 2210/561* (2013.01); *G10H 2250/455* (2013.01); *G10H 2250/481* (2013.01)

(58) Field of Classification Search
CPC ..... G10H 1/366; G10H 2210/066; G10H 2210/081; G10H 2210/165; G10H 2210/561; G10H 2250/455; G10H 2250/481; G10H 1/02; G10H 1/44; G10H 1/46
USPC ..... 84/610
See application file for complete search history.

(56) References Cited

U.S. PATENT DOCUMENTS 5,525,062 A * 6/1996 Ogawa ..... G09B 15/00 386/230
5,621,182 A * 4/1997 Matsumoto ..... G10H 1/366 434/307 A
5,750,912 A * 5/1998 Matsumoto ..... G10H 1/366 434/307 A
5,857,171 A * 1/1999 Kageyama ..... G10H 1/366 704/268
5,889,223 A * 3/1999 Matsumoto ..... G10H 1/366 434/307 A
5,889,224 A * 3/1999 Tanaka ..... G10H 1/361 434/307 A
5,955,693 A * 9/1999 Kageyama ..... G10H 1/366 84/610
5,963,907 A * 10/1999 Matsumoto ..... G10H 1/365 434/307 A
7,825,321 B2 * 11/2010 Bloom ..... G10H 1/366 84/622
7,974,838 B1 * 7/2011 Lukin ..... G10H 1/366 704/207
8,423,367 B2 * 4/2013 Saino ..... G10H 1/0008 704/267

(Continued)

*Primary Examiner* — Jeffrey Donels
(74) *Attorney, Agent, or Firm* — Andrew Naglestad

(57) ABSTRACT

A singing voice conversion system configured to generate a song in the voice of a target singer based on a song in the voice of a source singer is disclosed. The embodiment utilizes two complementary approaches to voice timbre conversion. Both combine the natural prosody of a source singer with the pitch of the target singer—typically the user of the system—to achieve realistic sounding synthetic singing. The system is able to transpose the key of any song to match the automatically determined or desired pitch range of the target singer, thus allowing the system to generalize to any target singer, irrespective of their gender, natural pitch range, and the original pitch range of the song to be sung.

2 Claims, 3 Drawing Sheets

(56) References Cited

U.S. PATENT DOCUMENTS

| | | | | |
|---|---|---|---|---|
| 9,818,396 | B2 * | 11/2017 | Tachibana | G10L 13/0335 |
| 2013/0019738 | A1 * | 1/2013 | Haupt | G10H 1/06 84/622 |
| 2015/0040743 | A1 * | 2/2015 | Tachibana | G10H 1/361 84/622 |

* cited by examiner

METHOD AND SYSTEM FOR SPEECH-TO-SINGING VOICE CONVERSION

CROSS-REFERENCE TO RELATED APPLICATION(S)

This application claims the benefit of U.S. Provisional Patent Application Ser. No. 62/377,462 filed Aug. 19, 2016, titled "Method and system for speech-to-singing voice conversion," which is hereby incorporated by reference herein for all purposes.

TECHNICAL FIELD

The invention generally relates to a voice conversion system. In particular, the invention relations to a system and method for converting spoken voice data into a singing voice to produce a song with vocal and instrumental components.

BACKGROUND

Voice conversion technologies have historically been designed to convert a user's speaking voice to that of some target speaker. Typical systems convert only the voice color, or timbre, of the input voice to that of the target, while largely ignoring differences in pitch and speaking style, prosody, or cadence. Because speaking style contains an enormous amount of information about speaker identity, a usual result of this approach to conversion is an output that only partially carries the perceivable identity of the target voice to a human listener.

Style, cadence, and prosody are arguably even more important factors in generating a natural-sounding singing voice, at least because the melody of a given song is quite literally defined by the pitch progression of the singing voice, and at most because "style" is often the defining quality of a singer's identity. Converting or generating synthetic singing voices is thus complicated by the challenges inherent to speech prosody modeling.

To successfully achieve speech-to-singing voice conversion, a method for utilizing, obtaining, or otherwise generating a natural and stylistic pitch progression that follows the melody of the song is necessary. Further necessary is a technique for automatically imposing that progression on the target voice data in a way that avoids unnatural, digital artifacts, due to, for example, artificially adjusting the pitch of the target voice too far from its natural range.

SUMMARY

The invention in the preferred embodiments feature a novel singing voice conversion system configured to generate a song in the voice of a target singer based on a song in the voice of a source singer as well as speech of the target. Two complementary approaches to voice timbre conversion are disclosed. Both combine the natural prosody of a source singer with the pitch of the target singer—typically the user of the system—to achieve realistic sounding synthetic singing. The system is able to transpose the key of any song to match the automatically determined or desired pitch range of the target singer, thus allowing the system to generalize to any target singer, irrespective of their gender, natural pitch range, and the original pitch range of the song to be sung.

The two complementary approaches to voice timbre conversion give rise to two embodiments of the system. The first enables the target singer to generate an unlimited number of songs in his or her voice given the necessary data assets and a static set of target voice data. The second embodiment requires unique speech data for each new song to be generated, but in turn gives rise to higher-quality synthetic singing output.

In the first preferred embodiment, the singing voice conversion system comprises: at least one memory, a vocal conversion system, an instrumental conversion system, and an integration system. The vocal conversion system is generally configured to map source voice data to target voice data and modify that target voice data to represent a target pitch selected by a user, for example. The instrumental conversion system is generally configured to alter the pitch and the timing of an instrumental track to match the target pitch selected by the user. The integration system then combines the modified target voice data and modified instrumental track to produce a song that possesses the words sung by the source singer but sounding as though they were sung by the target, i.e., the user.

In the second preferred embodiment, the singing voice conversion system comprises: at least one memory including lyric data, a vocal conversion system, an instrumental conversion system, and an integration system. The vocal conversion system is configured to process the target voice data to impart the phonetic timing of the lyric data as well as a target pitch selected by the user. The instrumental conversion system is generally configured to alter the pitch and the timing of an instrumental track to match the target pitch selected by the user. The integration system then combines the modified target voice data and modified instrumental track to produce a song that possesses the words sung by the source singer but sounding as though they were sung by the target, i.e., the user.

DETAILED DESCRIPTION OF THE PREFERRED EMBODIMENT

Figure 1:
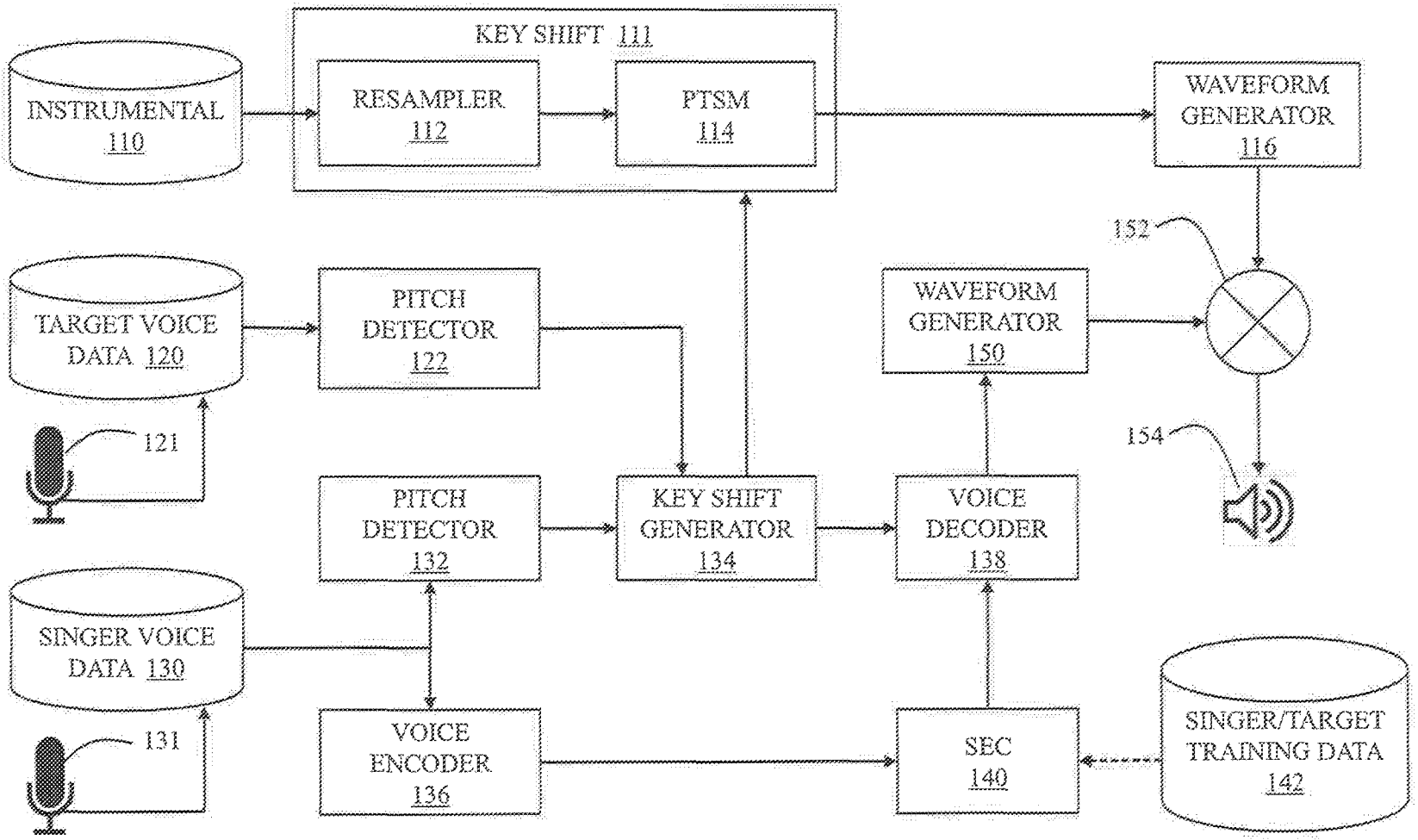
FIG. 1 is a functional block diagram of a singing voice conversion system, in accordance with the first preferred embodiment of the present invention.

The invention features a system and method for generating a song from a user's voice. The user's voice is processed to adjust the timing of the instrumental portion of the song and to convert the original singer's voice into target vocals synchronized with the instrumental portion of the song. The output of the system is a song that has the voice of the user, the pitch of the user, and the melody tailored to the key of the user, but the words and instrumental content of the original song. Stated differently, the perceived identity of a voice in the song is changed from the original singer to that of the user (i.e., "target singer").

In the preferred embodiment, the singing voice conversion (SVC) system comprises three main components: (a) an instrumental conversion system configured to process the instrument-only portion of a song, (b) a vocal conversion system configured to process the singer(s) voice-only portion of the song, and (3) an integration system that combines the instrumental and vocal components after processing.

The instrumental conversion system preferably includes a re-sampler 112 and a polyphonic time-scale modifier (PTSM) 114. In operation, an instrumental recording, i.e., track, consists of audio from musical instruments and is devoid of all the vocals, or at least devoid of the "lead" vocal track. The instrumental recording is provided as input from the instrumental database 110 or microphone (not shown). The track typically comprises a digital audio file recorded at a particular sampling rate, which is the number of samples per second of the analog waveform. The track may have been previously recorded at one of a number of sampling rates that are typically used in the music industry, including 8 kHz, 16 kHz, 44.1 kHz, or 48 kHz, for example.

If the pitch of the user is different than the pitch of the original singer, the pitch of the instrumental recording is also altered to accommodate the new pitch of the user. The pitch of the instrumental recording may be altered by first resampling the instrumental recording to achieve the target pitch, which changes the length of the recording, and then applying a time-scale modification algorithm to restore the original length of the recording without altering the pitch. To start, the resampler 112 modifies the original sampling rate by either increasing (up-sampling) or decreasing (down-sampling) the sampling rate with respect to the original audio recording. The precise sampling rate at which the instrumentals are resampled, i.e., resampling rate, is chosen to produce the necessary pitch shift when played back at the original sampling rate. To decrease the pitch, for example, the instrumental recording is up-sampled and then played back at the original sampling rate.

As a consequence of the resampling process, however, the length of the instrumental recording is effectively changed. Down-sampling effectively shortens the length of the track while up-sampling increases the length of the track. To restore the original length of the track, the PTSM 114 applies a time-scale modification algorithm to resample the already-resampled output of the resampler 112, which corrects the length of the track without any loss in quality or change in the perceived pitch. In the preferred embodiment, the PTSM 114 achieves time-scale modification using a "phase vocoder" algorithm proposed by Flanagan and Golden, as described in the paper by J. L. Flanagan and R. M. Golden, "Phase vocoder," in The Bell System Technical journal, vol, 45, no. 9, pp. 1493-1509, November 1966, which is hereby incorporated by reference herein. The resulting track may then be characterized by a key that matches the pitch of the target singer and a length equal to the length of the original track.

The SVC also comprises a vocal conversion system configured to convert the original singer's voice into the voice of the user, i.e., the target voice or target singer voice. The vocal conversion system comprises a voice encoder 136, a spectral envelope converter (SEC) 140, a voice decoder 138, a pitch detector 132, and a key shift generator 134. In operation, the singer voice data 130 is first provided as input to the voice encoder 136. The singer voice data may be streamed from a microphone 131 or retrieved from a database. The original singer voice data may include one or more isolated and dry vocal tracks that contain only monophonic melodies. One track may contain multiple singers, but those singers cannot be singing simultaneously. The term "dry" refers to a vocal performance that is captured in a virtually anechoic chamber and does not include any common post-processing or effects that would undo the recording's monophonicity, e.g., an echo that could cause repetitions to overlap the lead vocal melody.

The voice encoder 136 then generates spectral profiles of the singer voice data. In particular, the voice encoder 136 generates estimates of spectral envelopes from the vocal track at 5-10 milliseconds intervals in time, synchronous with the pitch detector 132. The plurality of spectral envelopes are low-pass filtered to remove pitch information and then transmitted to the SEC 140 where each spectral envelope of the singer's voice is converted to a new spectral envelope corresponding to the target singer's voice, i.e., the user's speech. That is, the SEC modifies the spectral shape in a way that only affects the speaker identity but not the phonetic content. In the preferred embodiment, the SEC is a deep neural network (DNN) that has been trained using original singer training data and target singer training data 142. In the preferred embodiment, the DNN comprises an input layer, an output layer, and three hidden layers consisting of 1024 nodes each.

In parallel to the SEC, the pitch detector 132 estimates (a) an average of the pitch of the original singer's voice in the singer voice data 130, and (h) the instantaneous pitch of the singer voice data 130 for the duration of the song. The average pitch, $f_0$, and instantaneous pitch are transmitted to the key shift generator 134. With regard to the instantaneous pitch, the pitch detector 132 produces an estimate of the vocal pitch (i.e., the frequency at which the singer's vocal cords are vibrating) at 5-10 millisecond intervals of time. Regions of the recording in which there is silence or "unvoiced speech"—i.e., speech sounds that do not require the vocal cords to vibrate, such as "s" or "f"—are assigned an estimate of 0 (zero) pitch. In the preferred embodiment, the average and instantaneous pitch are generated in advance of the conversion of a particular song, stored in the database as part of the singer voice data 130, and transmitted to the key shift generator 138 as needed during singing voice conversion operations.

Next, the key shill generator 134 is configured to (a) determine the target frequency, t, to change the key of the melody and match the target singer's voice, (h) determine the number of half notes, n, necessary to change the key of the song, and (c) produce an estimate of an instantaneous target voice pitch.

In one embodiment, the key shift generator 134 sets the target frequency, t, equal to the average pitch or median pitch of the user's voice or perhaps one octave higher. The user's voice is represented by the target voice data 120. The average pitch or median pitch is determined by the pitch detector 122.

In a second embodiment, target frequency is selected from one of a plurality of pre-defined ranges for different singing styles in Table 1:

TABLE I

| Type of singer | Frequency range | Note range | Gender of target singer |
|---|---|---|---|
| Soprano | 247-1568 Hz | B3-G6 | Female |
| Mezzo-soprano | 196-880 Hz | G3-A5 | Female |
| Contralto ("Alto") | 165-698 Hz | E3-F5 | Female |
| Tenor | 131-494 Hz | C3-B4 | Male |
| Baritone | 98-392 Hz | G2-G4 | Male |
| Bass | 73-330 Hz | D2-E4 | Male |

If a target male singer would like to sing a song originally performed by a female, the key could be shifted such that the highest note in the melody is G4 at 392 Hz, which would place the melody in the "Baritone" range. The user may, therefore, specify the target frequency or choose a target "type of singer" and the target frequency automatically determined from a frequency within the frequency range of that type of singer.

Next, the key shift generator 134 determines the number of half notes, n, necessary to change the key of the song to match the target singer's voice. The number of half notes with which to modify the melody is preferably based on the average frequency of the melody, $f_0$, and target frequency for the shifted melody, t. The formula for the number of half steps, n, needed to shift the key of the song is given by:

$$n = \frac{12}{\log(2)}(\log(t) - \log(f_0))$$

Since the number of half steps, n, should be an integer value, the result of the equation is rounded.

Given the value of n, the key shift generator 134 determines a new sampling rate with which to shift the key of the recording of the song. In particular, the resampler 112 resamples the instrumental track from its original sampling rate, $f_s$, to $$\hat{f}_s = 2^{\frac{n}{12}} f_s.$$

As one skilled in the art will recognize, the re-sampled audio is subsequently played back at the original sampling rate, $f_s$. While this resampling process appropriately increases or decreases the pitch, as desired, it also proportionally decreases or increases the duration of the recording, respectively. Therefore, after the resampling process, the PTSM 114 implements a time-scale modification algorithm to restore the recording to its original length without changing the pitch. The time-scale modification is performed by the PTSM 114 in the manner described above.

The key shift generator 134 also shifts the instantaneous pitch of the singer voice data 130 to produce an estimate of an instantaneous target voice pitch. This instantaneous target voice pitch is shifted by the same number of half steps, n, as the instrumental track described above.

The voice decoder 138 receives (a) the plurality of estimates of the instantaneous target pitch from the key shift generator 134 and (b) estimates of the target singer spectral profiles from the SEC 140. The voice decoder 138 is configured to then modify each of the plurality of spectral envelopes produced by the SEC 140 to incorporate its corresponding instantaneous pitch estimate. That is, each target frequency represented by the instantaneous target voice pitch is used to modulate the corresponding target singer spectral profile. After modulation, the plurality of target singer spectral profiles reflect the melody of the song, the pitch of the user, and the speech content recited by the singer, The SVC further includes an integration system which is configured to mix the outputs of the instrumental conversion system and vocal conversion system. The key-shifted instrumental track from the PTSM 114 is transmitted to a first waveform generator 116, and the pitch-shifted vocals from voice decoder 138 are transmitted to a second waveform generator 150. These waveform generators 116, 150 output analog audio that are then combined by the mixer 152 to produce a single audio signal which is available to be played by the speaker 154 on the user's mobile phone, for example.

Figure 2:
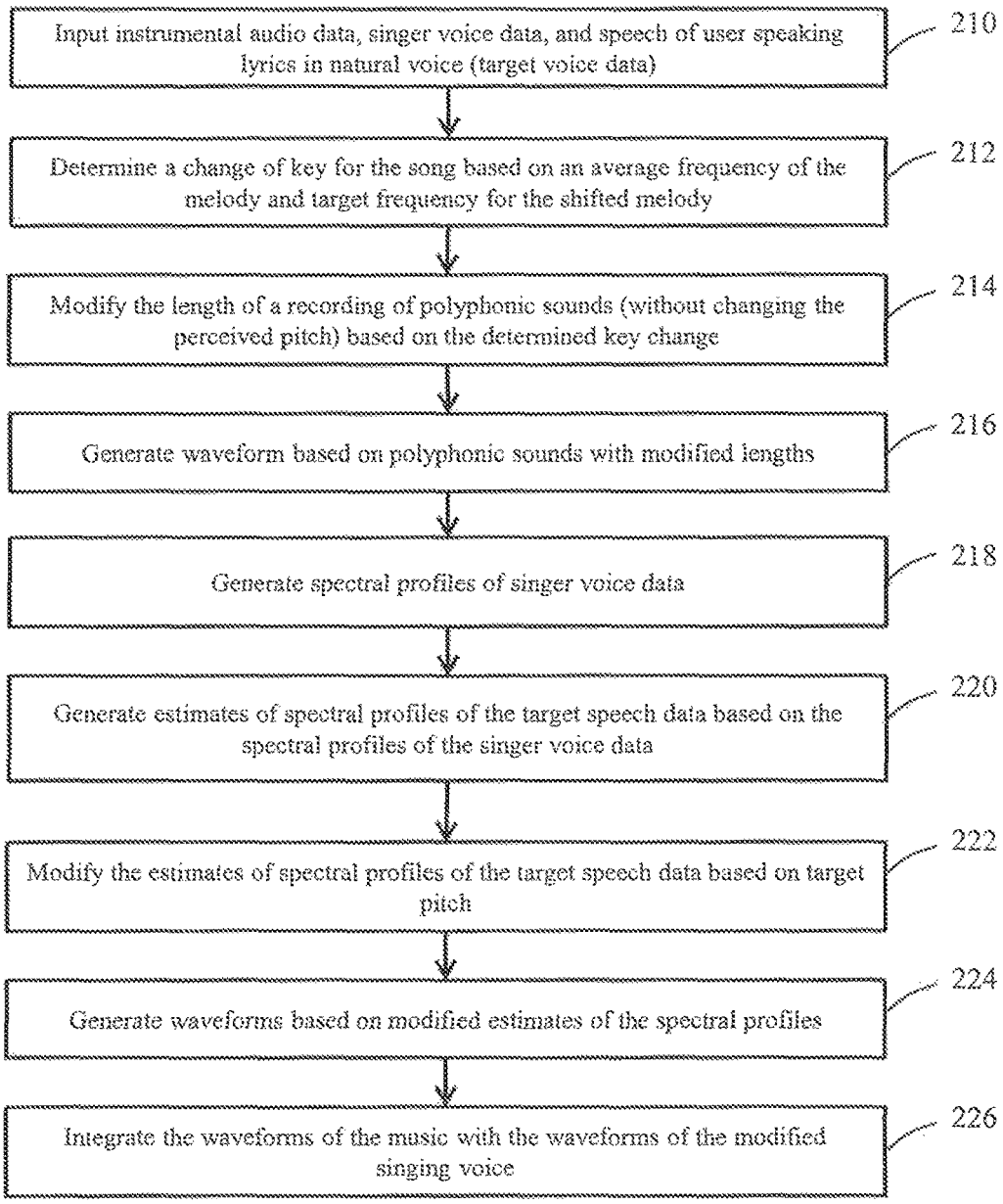
FIG. 2 is a flowchart of a method for generating an output song in the voice of the target speaker, in accordance with the first preferred embodiment of the present invention.

Illustrated in FIG. 2 is a flowchart of a method for generating an output song in the voice of the target speaker. First, the instrumental audio data, singer voice data, and speech of user speaking lyrics in a natural voice, i.e., the target voice data, are provided 210 as input to the SVC system. The key of the song is generally modified, so the new key for the song is determined 212 based on the average frequency of the initial melody and target frequency for the shifted melody. Based on the determined key change, the length of the polyphonic sounds recording are changed 214 without changing the perceived pitch. A waveform is generated 216 based on the plurality time-modified polyphonic sounds.

In parallel with the generation of the instrumental waveform above, the SVC system also generates a vocal waveform. First, spectral profiles of the singer voice data are generated 218. These spectral profiles are then transformed 220 or used to select matching estimates of spectral profiles from the target speech data. The pitch of spectral profiles from the target speech data are modified 222 based on average of the singer speech data and the target frequency to be used to modify the key of the melody. Waveforms are then generated 224 from the pitch-modified estimates of the target speech spectral profiles. The waveforms of the instrumentals are mixed 226 or otherwise integrated with the waveforms of the modified singing voice to produce audio signals that can be played by a speaker on the user's mobile phone, for example.

Figure 3:
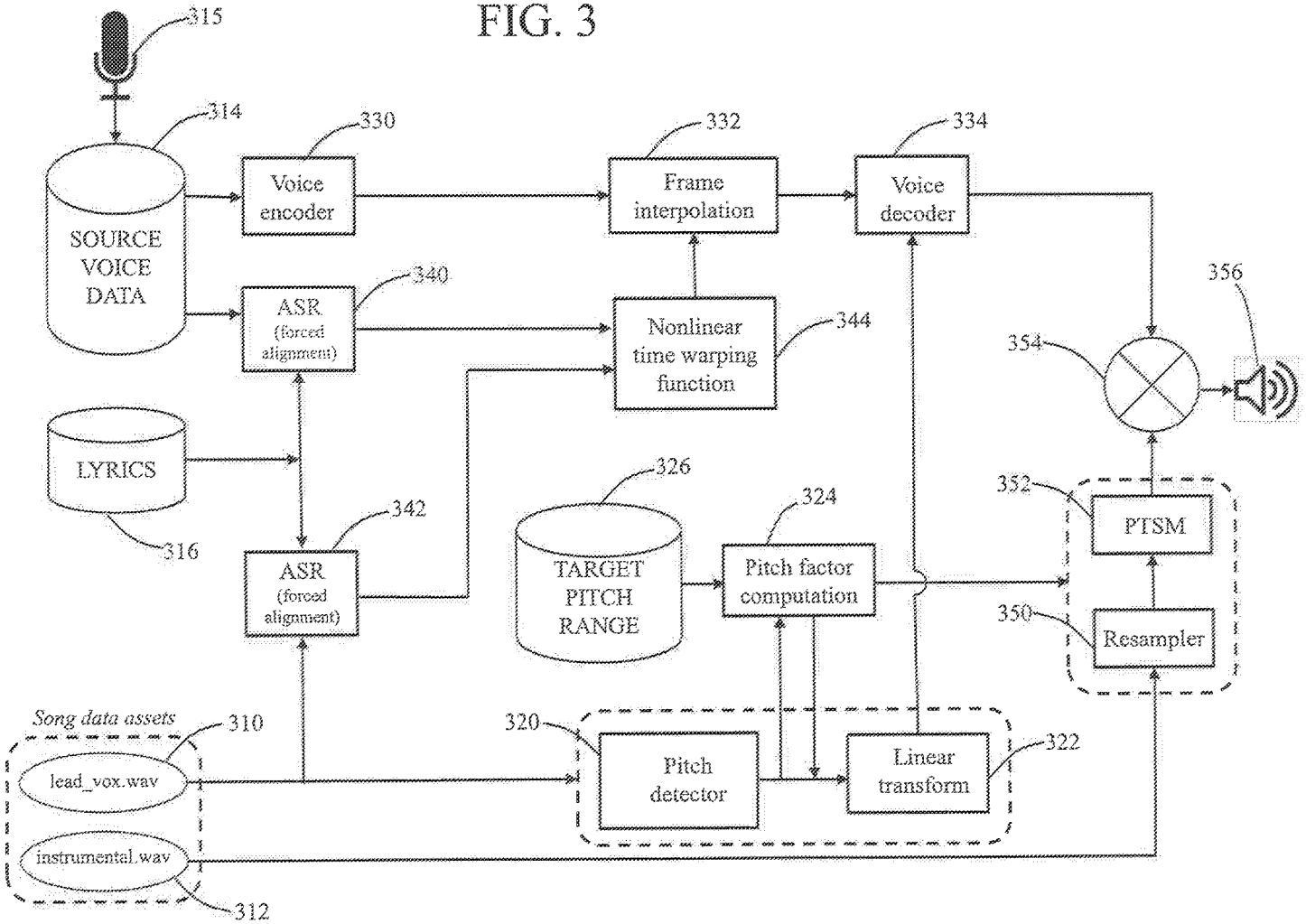
FIG. 3 is a functional block diagram of a singing voice conversion system, in accordance with the second preferred embodiment of the present invention.

Illustrated in FIG. 3 is a functional block diagram of a second embodiment of a singing voice conversion system. The input to the SVC system includes (a) a dry template vocal track 310 consisting of the singer's voice only and no music, (b) a background music track 312 consisting of instruments only and optionally backup vocals, (c) voice data 314 including the user speaking the exact lyrics, as displayed on the screen of the user's mobile phone for example, and (d) a template 316 of the song being sung with the proper e.g., text data including the song lyrics in the vocal track 310 as well as the exact timing of those lyrics at the phonetic level. In general, the VSC system aligns the user's speech 314 in time against a template of the song being sung with the proper timing and melody. In particular, the user's speech recording is directly modified to have the exact same timing and melody as the template. A recording containing the background music only (e.g., a karaoke track) is then merged with the modified recording of the user's speech. The final result is a recording of the excerpt of the song effectively being "sung" by the user.

The VSC system preferably includes (a) an instrumental conversion system configured to process the instrument-only portion of a song, (b) a vocal conversion system configured to process the singer(s) voice-only portion of the song, and (3) an integration system that combines the instrumental and vocal components after processing.

The instrumental conversion system includes a resampler 350 and PTSM 352. As described above, the resampler 350 modifies the original sampling rate by either increasing (up-sampling) or decreasing (down-sampling) the sampling rate with respect to the original audio recording. The precise resampling rate is chosen by the pitch factor generator 324 to produce the necessary pitch shift when played back at the original sampling rate. The change in pitch is based on (a) the initial pitch of the original vocal track 310, as determined by pitch detector 320, and (b) the target frequency for the song, as selected by the user from a plurality of pitch choices presented in TABLE I and represented by database 326. The PTSM 352 applies the time-scale modification algorithm to again resample the track to correct the length of the track, and then outputs an instrumental track with the determined pitch and appropriate timing.

The VSC system further includes a vocal conversion system configured to process the singing voice-only portion of the song. The vocal conversion system includes an automatic speech recognition module (ASR) 340, and ASR 342, and a time-warping module 344. The ASR 340 determines the boundaries of the segments, preferably phonemes, of user speech, while the ASR 342 determines the boundaries of the speech segments for the template of the lyrics 316. Based on the phoneme boundaries determined by ASRs 340, 342, the alignment module 342 computes a nonlinear time warping function (timing data) that aligns the timing of the user's speech 314 to that of the template from the lyrics database 316.

The vocal conversion system further includes a voice encoder 330 and frame interpolation module 332. The voice encoder 330 is configured to parse and convert the user's speech data into a sequence of spectral envelopes, each envelope representing the frequency content of a 5-10 millisecond interval of user speech. The spectral envelopes are then processed by the interpolation module 332 to match the timing of the user speech after treatment by the time warping module 344. That is, the frame interpolation module 332 creates new spectral envelope frames to expand the user speech, or delete spectral envelopes to contract the user speech based on said timing data. The output of the interpolation module 332 is a new sequence of spectral envelopes reflecting the phonetic content of the user speech and the phonetic timing of the lyric template.

The VSC system further includes an integration system comprising a voice decoder 334 and mixer 354. The voice decoder 334 is configured to modify each of the plurality of spectral envelopes produced by the frame interpolation module 332 to incorporate corresponding instantaneous pitch estimates from the linear transform module 322. That is, target pitch estimates are used to modulate the corresponding spectral profiles. After modulation, the plurality of user spectral profiles reflect the melody of the song, the pitch chosen by the user from the target pitch range database 326, and the speech content recited by the singer.

Lastly, the mixer 354 merges the recording containing the background music only—e.g., a karaoke track—with the modified recording of the user's speech. The final result is a recording of the excerpt of the song effectively being "sung" by the user, which can be played by the speaker 356

In a third embodiment, similar to the second embodiment above, enables the user to speak any arbitrary sequence of English words. The input speech recording is manipulated in timing and pitch, as described above, such that the user's speech is sung according to the timing and melody of the reference song excerpt. First, the voice conversion system divides the input speech recording into a sequence of syllables. This syllable sequence is then aligned against the corresponding pre-computed syllable sequence of the actual lyrics. The audio segments corresponding to each syllable of the input are increased or decreased in duration to match the duration of syllable(s) to which they were matched in the template. The result after speech audio resynthesis is a recording of the user's speech following the timing and melody of the selected song excerpt. As before, the background music is merged with the result.

One or more embodiments of the present invention may be implemented with one or more computer readable media, wherein each medium may be configured to include thereon data or computer executable instructions for manipulating data. The computer executable instructions include data structures, objects, programs, routines, or other program modules that may be accessed by a processing system, such as one associated with a general-purpose computer or processor capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system. Examples of mass storage devices incorporating computer readable media include hard disk drives, magnetic disk drives, tape drives, optical disk drives, and solid state memory chips, for example. The term processor as used herein refers to a number of processing devices including personal computing devices, servers, general purpose computers, special purpose computers, application-specific integrated circuit (ASIC), and digital/analog circuits with discrete components, for example.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

I claim:

1. A singing voice conversion system configured to generate a song sung by a target singer from a song sung by a source singer, the singing voice conversion system comprising:

at least one memory comprising:

a) instrumental data consisting substantially of instrumental music;

b) singer voice data consisting of a singer voice; and c) target voice data; and a vocal conversion system configured to process the singer voice data, the vocal conversion comprising:

a) a voice encoder configured to generate a plurality of source spectral envelopes representing the singer voice data;

b) a spectral envelope conversion module configured to generate a target spectral envelope representing a target voice based on each of the plurality of source spectral envelopes and target voice data;

c) a pitch detector configured to generate:

i) an average pitch from the singer voice data; and ii) a plurality of instantaneous pitch estimates, each instantaneous pitch estimate corresponding to one of the plurality of source spectral envelopes;

d) a key shift generator configured to:

i) determine a target frequency for the song sung by the target singer;

ii) determine a number of half steps between the average pitch from the singer voice data and target frequency;

iii) generate a plurality of instantaneous target voice pitch estimates for the song sung by the target singer; and e) a voice decoder configured to incorporate a pitch into each of the plurality of target spectral envelopes produced by the spectral envelope conversion module based on the plurality of instantaneous target voice pitch estimates for the song sung by the target singer;

an instrumental conversion system configured to process the instrumental data, the instrumental conversion system comprising:

a) a resampler configured to resample the instrumental data by either increasing or decreasing a sampling rate of the instrumental data to produce a pitch shift; and b) a polyphonic time-scale modifier configured to modify a length of the instrumental data from the resampler without a change in pitch; and an integration system comprising:

a) a first waveform generator configured to generate a first waveform from the instrumental data from the polyphonic time-scale modifier;

b) a second waveform generator configured to generate a second waveform from the target speech data from the voice decoder;

c) a mixer configured to combine the first waveform and second waveform into a single audio signal; and d) a speaker configured to play the audio file.

2. A singing voice conversion system configured to generate a song sung by a target singer from a song sung by a source singer, the singing voice conversion system comprising:

at least one memory comprising:

a) instrumental data consisting substantially of instrumental music;

b) singer voice data consisting of a singer voice;

c) target voice data; and d) lyric data comprising phonetic timing;

a vocal conversion system configured to process the target voice data, the vocal conversion comprising:

a) a first automatic speech recognition module configured to determine phonetic boundaries from the target voice data;

b) a second automatic speech recognition module configured to determine phonetic boundaries from the lyric data;

c) an alignment module configured to generate timing data representing the alignment of the target voice data to the lyric data;

d) a voice encoder configured to generate a plurality of target spectral envelopes representing the target voice data;

e) a frame interpolation module configured to modify the plurality of target spectral envelopes based on the timing data from the alignment module;

f) a key shift generator configured to:

i) determine an average pitch from the singer voice data;

ii) determine a target frequency for the song sung by the target singer;

iii) determine a number of half steps between the average pitch from the singer voice data and target frequency;

iv) generate a plurality of instantaneous target voice pitch estimates for the song sung by the target singer; and g) a voice decoder configured to incorporate a pitch into each of the plurality of target spectral envelopes from the frame interpolation module based on the plurality of instantaneous target voice pitch estimates for the song sung by the target singer;

an instrumental conversion system configured to process the instrumental data, the instrumental conversion system comprising:

a) a resampler configured to resample the instrumental data by either increasing or decreasing a sampling rate of the instrumental data to produce a pitch shift; and b) a polyphonic time-scale modifier configured to modify a length of the instrumental data from the resampler without a change in pitch; and an integration system comprising:

a) a first waveform generator configured to generate a first waveform from the target speech data from the voice decoder;

h) a second waveform generator configured to generate a second waveform from instrumental data from the polyphonic time-scale modifier;

c) a mixer configured to combine the first waveform and second waveform into a single audio signal; and d) a speaker configured to play the audio file.

* * * * *